US007422465B2

(12) United States Patent
Watanabe et al.

(10) Patent No.: US 7,422,465 B2
(45) Date of Patent: Sep. 9, 2008

(54) ELECTRICAL CONNECTOR HAVING FLEXIBLE MATING PORTION

(75) Inventors: Tsuneki Watanabe, Yokohama (JP); Gwou-Jong Tseng, Tu-Cheng (TW); Meng-Huan Yang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/648,478

(22) Filed: Dec. 28, 2006

(65) Prior Publication Data

US 2007/0155243 A1 Jul. 5, 2007

(30) Foreign Application Priority Data

Dec. 29, 2005 (TW) ..... 94222916

(51) Int. Cl.
*H01R 13/627* (2006.01)

(52) U.S. Cl. ..... 439/353

(58) Field of Classification Search ..... 439/353, 439/357, 358

See application file for complete search history.

(56) References Cited

U.S. PATENT DOCUMENTS 5,584,718 A 12/1996 Sukegawa
6,231,393 B1 5/2001 Lai
6,290,530 B1 * 9/2001 Chang ..... 439/378
6,358,088 B1 3/2002 Nishio et al.
6,540,542 B1 * 4/2003 Simmel ..... 439/352
6,565,383 B1 * 5/2003 Wu ..... 439/567
6,607,397 B1 * 8/2003 Zhang et al. ..... 439/357
6,966,789 B2 * 11/2005 Takaku et al. ..... 439/353
6,997,733 B2 * 2/2006 Peng ..... 439/353
7,134,900 B2 * 11/2006 Chung ..... 439/353
2005/0245132 A1 * 11/2005 Huang et al. ..... 439/607
2005/0282424 A1 * 12/2005 Huang et al. ..... 439/353

* cited by examiner

*Primary Examiner*—Tulsidas C. Patel
*Assistant Examiner*—Vladimir Imas
(74) *Attorney, Agent, or Firm*—Wei Te Chung

(57) ABSTRACT

An electrical connector (100) adapted for connecting/disconnecting with/from a complementary connector in a front-to-back direction, comprises a shell (1), an insulative housing (2), a pair of locking members (3) and a plurality of contacts (4) received in the insulative housing. The shell comprises top surface (113), a pair of lateral surfaces (114) and a bottom surface (117), said surfaces defines a receiving space, one of the surfaces forms a pair of resilient tabs (1170) bent into the receiving space. The insulative housing received in the receiving space. The locking members assembled on the longitudinal opposite ends of the insulative housing and received in the receiving space, each forms a stopping projection (37) projecting therefrom into the receiving space. The resilient tabs, respectively, resist with the stopping projections of the locking members to stop the locking member from moving.

18 Claims, 7 Drawing Sheets

ELECTRICAL CONNECTOR HAVING FLEXIBLE MATING PORTION

CROSS-REFERENCE

This is related to U.S. patent application Ser. No. 10/401,082 filed on Apr. 10, 2006 and entitled "ELECTRICAL CONNECTOR ASSEMBLY WITH MULTI-FUNCTION LATCHING MEMBER", now U.S. Pat. No. 7,134,900, which have the same applicant and assignee as the present invention.

BACKGROUND OF THE INVENTION

1. Field of the Invention

The present invention relates to an electrical connector, and particularly to a micro electrical connector for mating with a complementary connector.

2. Description of Prior Arts

As the development, the electronic member becomes more and more smaller. Therefore, the electrical connector applied in the electronic member becomes more and more smaller subject to the electronic member. However, the mini electrical connector always has a weak structure so that the electrical and mechanical connection between the mini connectors becomes not firm. Accordingly, the locking members are used between the mini connectors to confirm the electrical and mechanical connection.

Obviously, it is desirable to have an improved structure to fix the locking members in the mini electrical connectors.

SUMMARY OF THE INVENTION

An object of the present invention is to provide an electrical connector to avoid damage to a complementary connector.

To achieve the above object, an electrical connector adapted for connecting/disconnecting with/from a complementary connector in a front-to-back direction, comprises a shell, an insulative housing, a pair of locking members and a plurality of contacts received in the insulative housing. The shell comprises a plurality of surfaces, said surfaces defines a receiving space, one of the surfaces forms a pair of resilient tabs bent into the receiving space. The insulative housing received in the receiving space. The locking members assembled on the longitudinal opposite ends of the insulative housing and received in the receiving space, each forms a stopping projection projecting therefrom into the receiving space. The resilient tabs, respectively, resist with the stopping projections of the locking members to stop the locking member has a movement.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
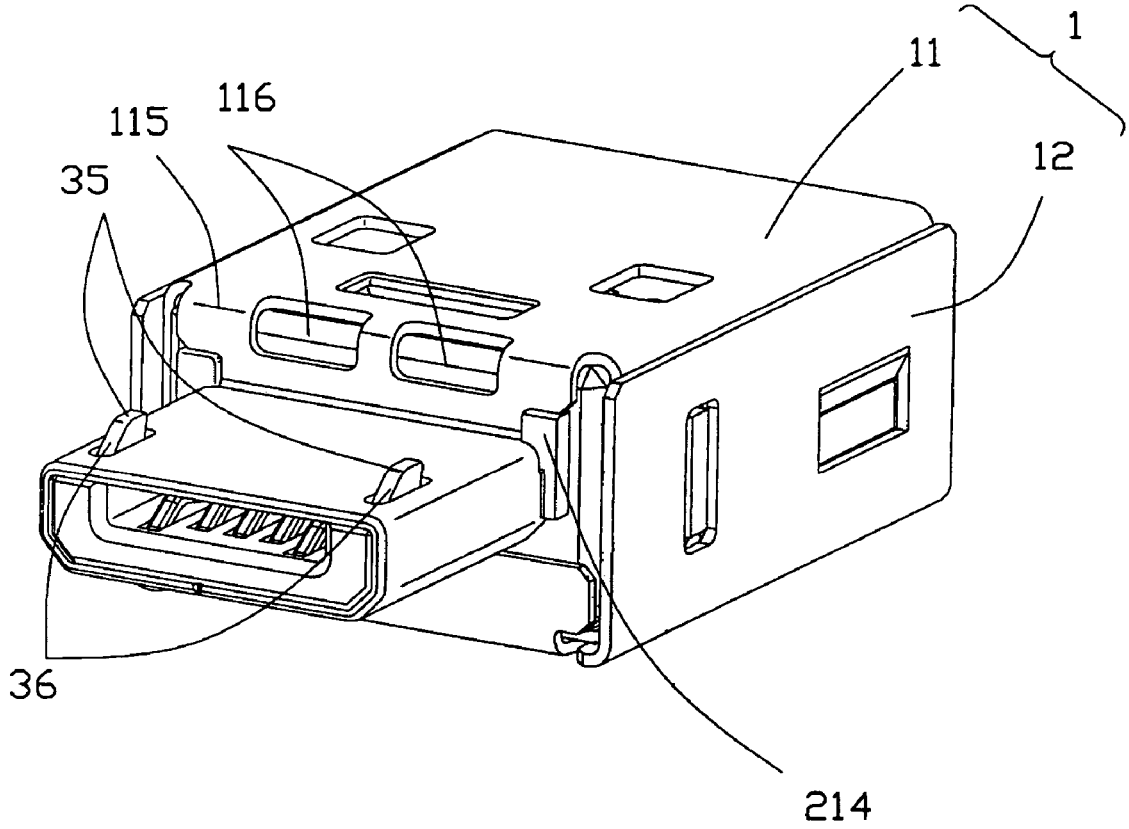
FIG. 1 is an assembled, perspective view of an electrical connector in accordance with the present invention.

Referring to FIGS. 1 to 4, an electrical connector 100 in accordance with the present invention comprises a metal shell 1, an insulative housing 2, a plurality of contacts 4 received in the insulative housing 2, a pair of locking members 3, and a stopping block 5. In the present embodiment, the electrical connector 100 is in accordance with a micro USB standard. However, in alternative embodiment, the electrical connector could be provided as other types.

Figure 2:
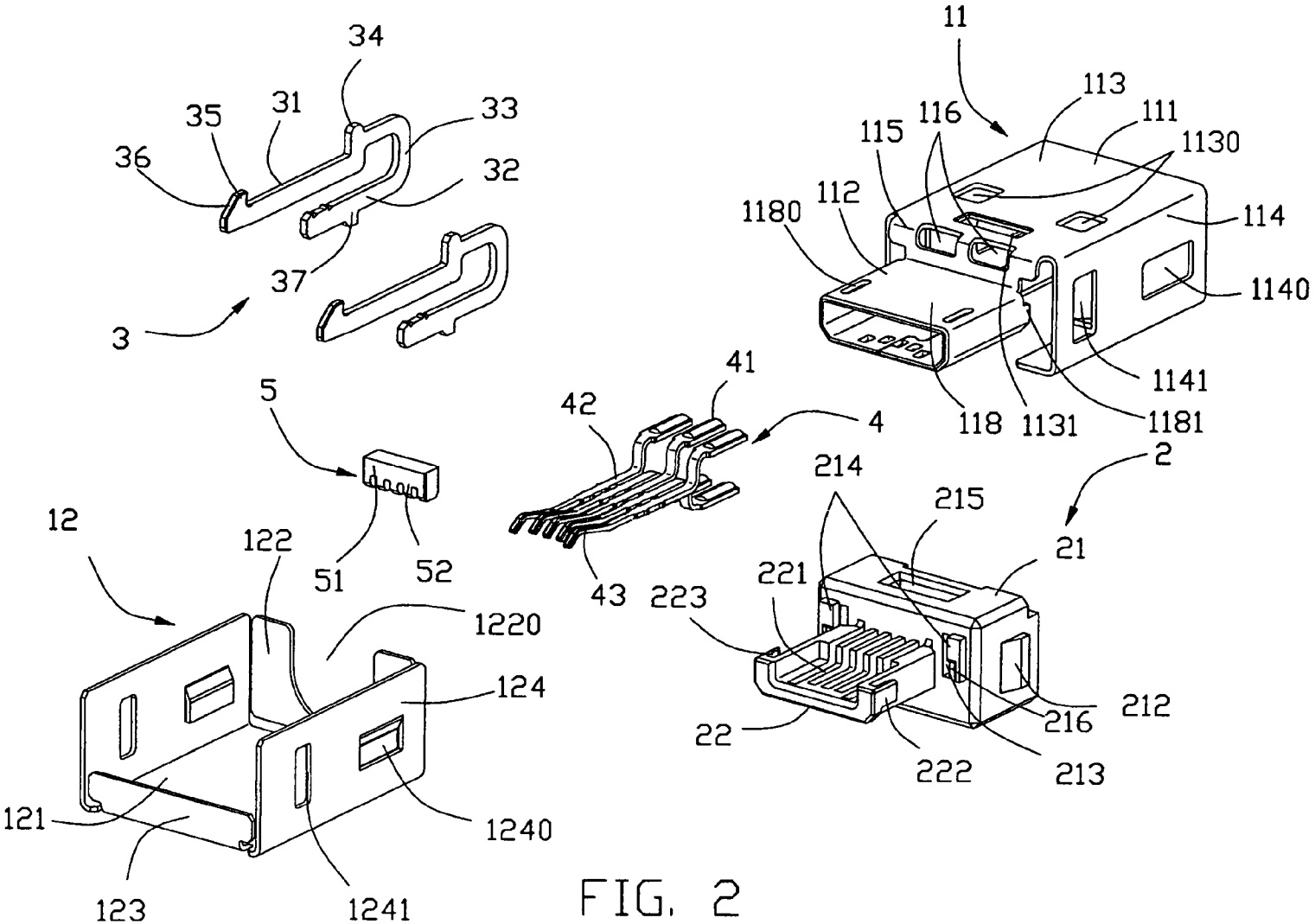
FIG. 2 is an exploded, perspective view of the electrical connector shown in FIG. 1.
Figure 3:
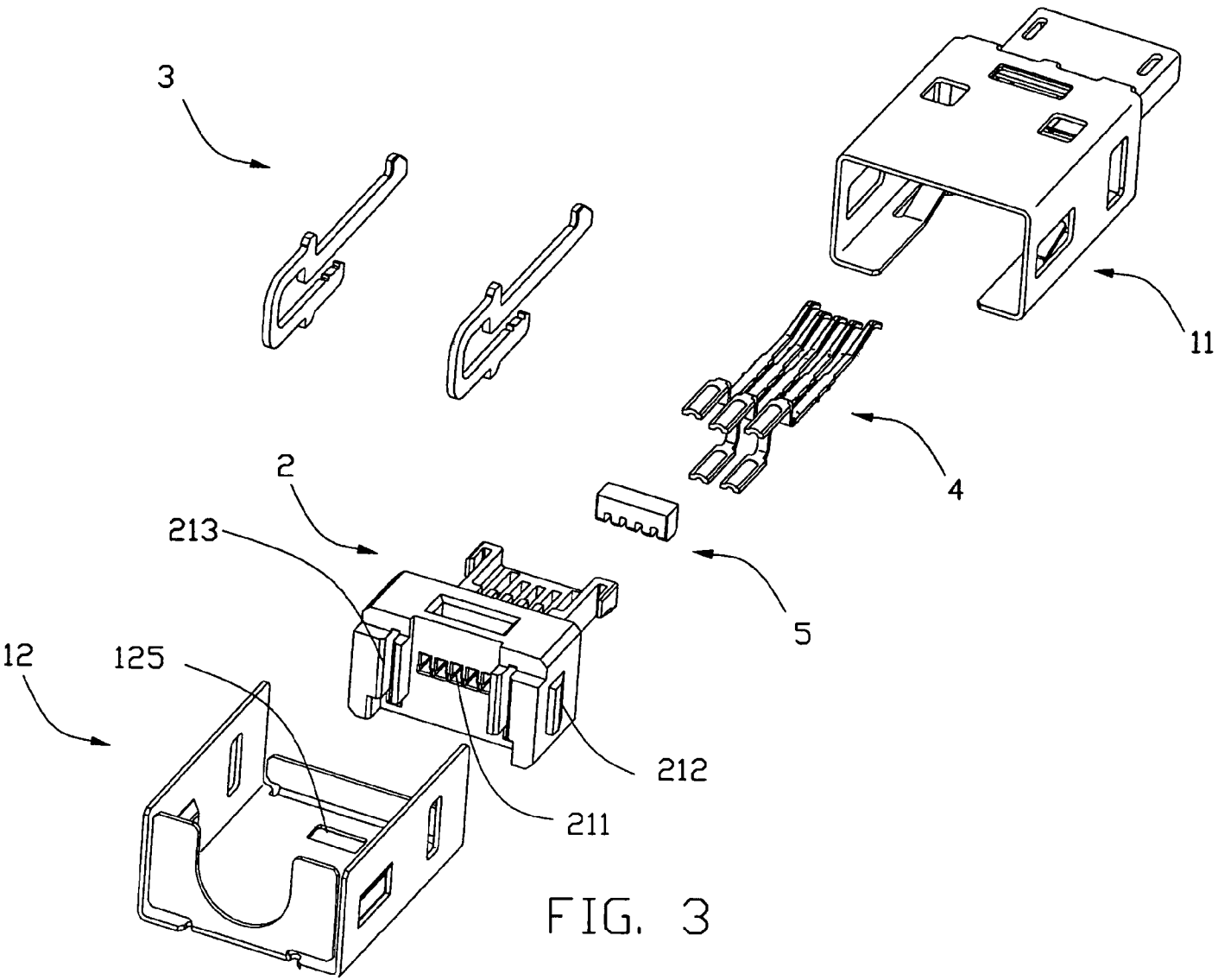
FIG. 3 is a view similar to FIG. 2, but taken from a different aspect.
Figure 4:
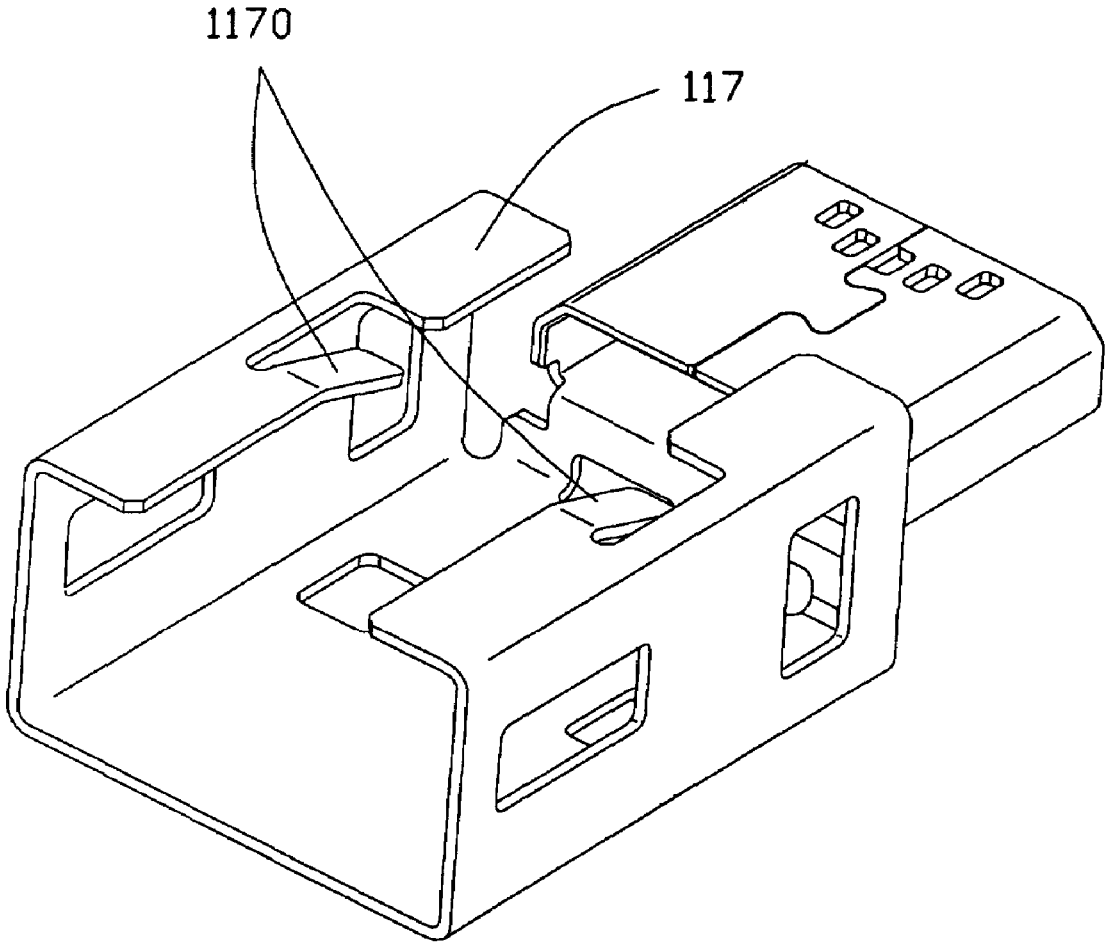
FIG. 4 is a perspective view of a shell of the electrical connector.
Figure 5:
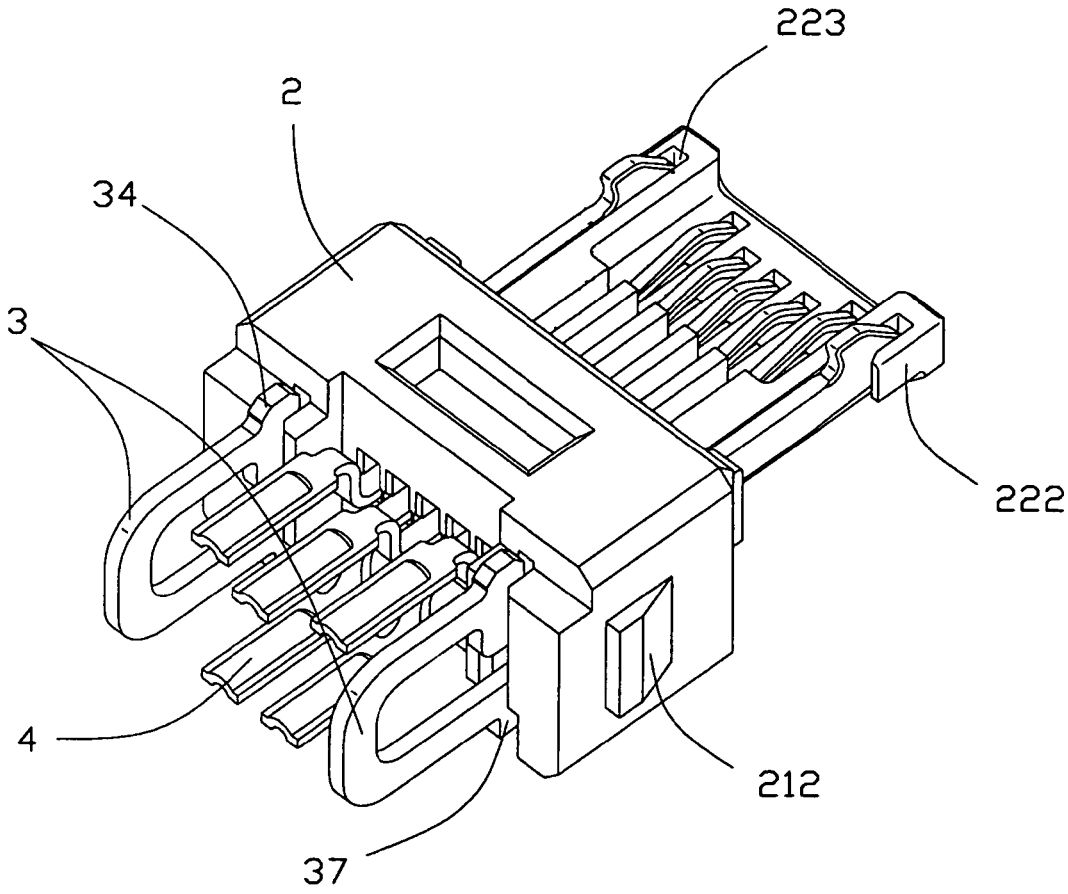
FIG. 5 is a partially assembled, perspective view of the electrical connector.
Figure 6:
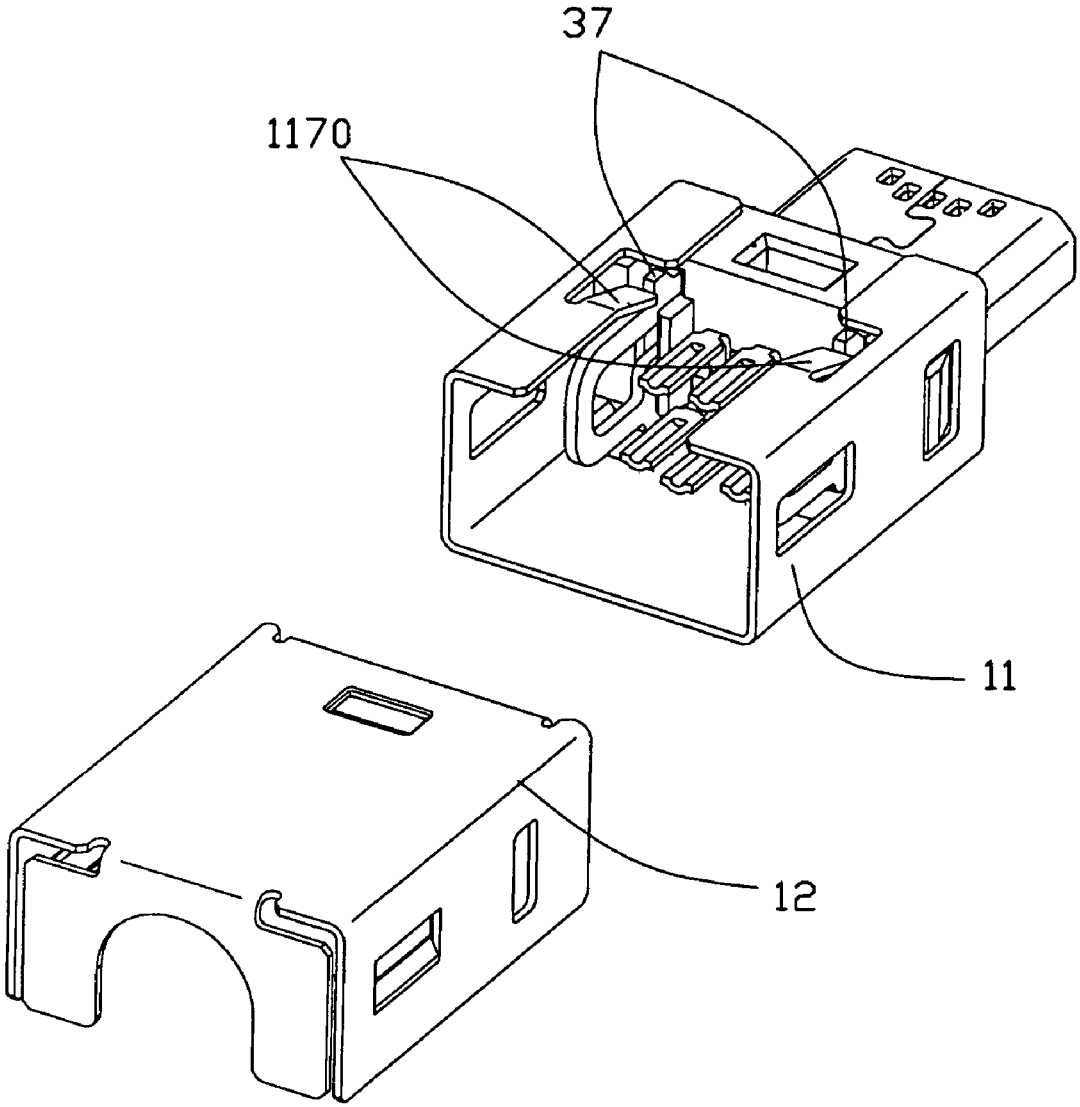
FIG. 6 is another partially assembled, perspective view of the electrical connector.
Figure 7:
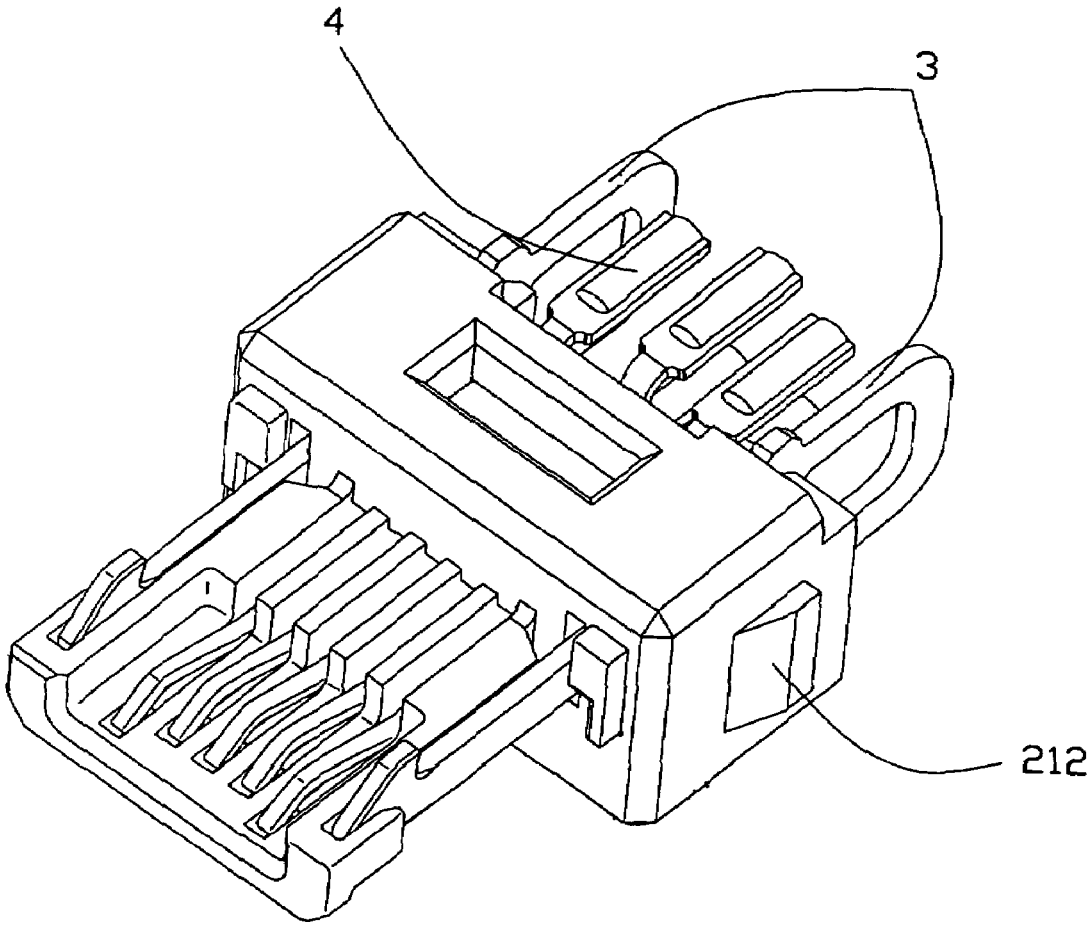
FIG. 7 is a view similar to FIG. 5, but taken from a different aspect.

Particularly referring to FIGS. 1 to 3, the metal shell 1 comprises a top shell 11 and a bottom shell 12. The top shell 11 comprises a main body 111, a connecting tab 115 and a mating portion 112. The main body 111 comprises a top surface 113, a pair of lateral surfaces 114 and a bottom surface 117 (shown in FIG. 4). The top surface 113 comprises a pair of first gaps 1130 and a second gap 1131 located more adjacent to the connecting tab 115 than that of first gaps 1130. Each lateral surface 114 defines a first cutout 1140 and a second cutout 1141. The bottom surface 117 has a jag (not labeled) thereon and a pair of resilient tabs 1170 bent inwardly from the opposite edges of the jag of the bottom surface 117. The connecting tab 115 is bent downwardly from the main body 111 along an up-to-down direction. The mating portion 112 extends forwardly from the connecting tab 115 along a front-to-back direction. Thereby, the mating portion 112 can move along the up-to-down direction relative to the main body 111 through the connecting tab 115. Certainly, the connecting tab 115 also can extend from the lateral surface 114, accordingly, the mating portion 112 move along a lateral direction relative to the main body 111. A pair of rectangular cutouts 116 are defined at a portion where the connecting tab 115 and the main body 111 join. The rectangular cutouts 116 are applied for decreasing the intension of the connecting tab 115, therefore, the connecting tab 115 can be bent more easily. The mating portion 112 defines a mating part 118, a pair of positioning tabs 1181 extending backwardly from rear edge thereof, and a pair of receiving cutouts 1180 at a surface of the mating part 118.

The bottom shell 12 comprises a bottom wall 121, a front wall 123, a rear wall 122 and a pair of lateral walls 124. These walls together define a receiving cavity (not labeled). The rear wall 122 of the bottom shell 12 has a receiving hole 1220 for cable (not shown) passing through. Each lateral wall 124 forms a block 1240 corresponding to the first cutout 1140 of the top shell 11 and a third cutout 1241 overlapped the second cutout 1141 of the top shell 11. The bottom wall 121 also defines a third gap 125 corresponding to the second gap 1131 of the top shell 11.

Each contact 4 comprises a contacting portion 43, a tail portion 41 and a retaining portion 42 connecting the contacting portion 43 and the tail portion 42. Each tail portion 41 is bent from the retaining portion 42 downwardly/upwardly along the up-to-down direction. So, the space between adjacent tail portions 41 becomes bigger, and it facilitates to solder the cable on the tail portions 41.

Each locking member 3 comprises a locking arm 31, a resilient arm 32 parallel with the locking arm 31 and a U-shape retaining arm 33. The locking arm 31 and the resilient arm 32 extend from the U-shape retaining arm 33 in a same direction. The locking arm 31 forms a bar 35 at the distal end thereof. The bar 35 forms an incline guiding face 36 thereon. The retaining arm 33 and the locking arm 31, respectively, forms a stopping projection 34, 37 for stopping the locking member 3 has a further movement into the housing 2.

The insulative housing 2 comprises a base portion 21 and a tongue portion 22 extending forwardly from the base portion 21 along the front-to-back direction. The base portion 21 comprises a plurality of receiving passageways 211 therein, and a pair of receiving slits 213 at the opposite ends of the receiving passageways 211. A pair of positioning blocks 214 is, respectively, besides corresponding receiving slits 213. Each positioning block 214 comprises a receiving portion 216 for fixing the connecting tab 115 of the top shell 11. The base portion 21 defines an upper engaging hole 215 and a lower engaging hole (not shown), respectively, defining at a top face and a bottom face thereof. The upper engaging hole 215 communicates with the receiving passageways 211, the lower engaging hole is separated with the receiving passageways 211. The tongue portion 22 defines a plurality of receiving slots 221 communicating with corresponding receiving passageways 211. A pair of the projecting portions 222 are defined at the opposite ends at the tongue portion 22 and form a pair of holding slits 223 with the tongue portion 22. The holding slits 223 are used to receiving die distal ends of the locking members 3, and restrict the movement of the locking member 3 in the lateral direction. The base portion 21 further forms a pair of retaining projections 212 at the opposite lateral faces.

The stopping block 5 receiving in the upper engaging hole 215 comprises a stopping section 51 and an engaging section 52.

During assembly, the contacts 4 are inserted into the housing 2 along the front-to-back direction. The retaining portion 42 of each contact 4 is received in corresponding receiving passageways 211, the contacting portion 43 extends into corresponding receiving slot 221 with tip end exposed outside, and the tail portion 41 is exposed beyond the housing 2. The stopping block 5 is inserted into the housing 2 through the upper engaging hole 215 along the up-to-down direction. The engaging section 52 of the stopping block 5 engages with the retaining portions 42 of the contacts 4, and the stopping section 51 engages with the inner face of the upper engaging hole 215. The upper face of the stopping block 5 is lower than the upper face of the base portion 21 of the housing 2. The locking members 3 are inserted into the receiving slits 213 with the distal end extending into the holding slits 223 and the stopping projections 34, 37 engaging with the rear face of the housing 2. The resilient arms 32 are exposed out of the housing 2.

During the housing 2 is inserted into the top shell 11, the resilient tabs 1170 are bent downwardly because of the pressure on the housing 2. When the base portion 21 of the housing 2 is completely received in the main body 111 of the top shell 11, the resilient tabs 1170 come back to original position, and respectively, resist with the stopping projections 37 of the locking member 3 to stop the locking member has a movement for stopping the locking member 3 to untie from the housing 2 in the front-to-back direction. The retaining projections 212 are received in corresponding second cutouts 1141. The tongue portion 22 is received in the mating part 118 of the mating portion 112 of the top shell 11. The positioning tabs 1181 are received in the receiving portions 216 of the positioning blocks 214. The positioning blocks 214 engage with the connecting tabs 115 in the up-to-down direction, and engage with rear edge of the mating portion 112 in the front-to-back direction. The positioning block 214 restricts the mating portion 112 and indicates weather the tongue portion 22 of housing 2 is completely received in the mating part 118. The stopping projection 34 of each locking member 3 is in a line with corresponding first gap 1130, and the bar 35 of each locking member 3 passes through corresponding receiving cutouts 1180 of the mating portion 112. The bottom shell 12 is assembled to the housing 2 and the top shell 11 from down to up. The blocks 1240 of the lateral wall 124 of the bottom shell 12 are received in the first cutouts 1140 of the top shell 11, the third cutouts 1241 hold the retaining projection 212 of the housing 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector adapted for connecting/disconnecting with/from a complementary connector in a front-to-back direction, comprising:

a shell comprising a plurality of surfaces jointly defining a receiving space therein, one of the surfaces formed with a pair of resilient tabs extending downward into the receiving space;

an insulative housing securely received in the receiving space and provided with a plurality of receiving passageways therein;

a plurality of contacts received in the receiving passageways of the insulative housing; and a pair of locking members assembled on the longitudinal opposite ends of the insulative housing and located in the receiving space, each including a stopping projection adjacent to the insulative housing;

wherein when the insulative housing along with the contacts is assembled into the shell, the free ends of the tabs of the shell will properly abut against the stopping projection on the locking member and prevent it from further inward movement.

2. The electrical connector as described in claim 1, wherein the insulative housing comprises a base portion and a tongue portion extending forwardly from the base portion, the base portion defines a pair of receiving slits extending therethrough at the opposite ends of said receiving passageways for receiving the locking members.

3. The electrical connector as described in claim 1, wherein each locking member comprises a locking arm, a retaining arm and a U-shape resilient arm connecting the locking arm and the retaining arm, and wherein said stopping projections formed at the retaining arms.

4. The electrical connector as described in claim 3, wherein the locking arm of the locking member forms a bar at the distal end thereof for locking with the complementary connector.

5. The electrical connector as described in claim 4, wherein the bar forms an incline guiding face thereon for inserted into the complementary connector.

6. The electrical connector as described in claim 4, wherein the shell comprises a top shell and a bottom shell separated with the top shell, said resilient tabs are defined at the top shell.

7. The electrical connector as described in claim 6, wherein the top shell comprises a main body and a mating portion extending from the main body, a pair of receiving cutouts at the mating portion, and wherein said bar of each locking member passes through and exposes out of the top shell.

8. The electrical connector as described in claim 4, wherein the tongue portion forms a pair of projecting portions at the opposite ends thereof, each projecting portions defines a holding slit with the tongue portion, and wherein the bars of locking member is received in corresponding holding slit of the housing.

9. The electrical connector as described in claim 7, wherein the top shell comprises a connecting tab extends downwardly from front edge of a top surface of the top shell.

10. The electrical connector as described in claim 9, wherein a cutout is defined at a portion where the main body and the connecting portion join.

11. The electrical connector as described in claim 1, wherein the housing forms a positioning block, and the shell forms a positioning tab corresponding to positioning block.

12. The electrical connector as described in claim 11, wherein the positioning block comprises a receiving portion for receiving the positioning tab of the shell.

13. The electrical connector as described in claim 1, wherein each contact comprises a contacting portion, a retaining portion extending rearwardly from the retaining and a tail portion bent from the retaining for soldering with a cable.

14. The electrical connector as claim 13, wherein the tail portion of one of the adjacent contacts is bent downwardly, and the tail portion of the other of the adjacent contact is bent upwardly.

15. The electrical connector as described in claim 13, wherein the shell has a receiving hole for the cable passing through.

16. An electrical connector comprising:

an insulating housing defining a mating portion;

a metallic shell enclosing the housing;

a plurality of contacts disposed in the housing;

a pair of locking member having a securement section retained to the housing; wherein the shell includes a tab forwardly abuts against an abutment section of the locking member so as to prevent rearward movement of the locking members with regard to the housing wherein said locking member defines a U-like configuration having said securement section and the abutment section on a same arm of said U-like configuration while a locking head is formed on the other arm of said U-like configuration.

17. An electrical connector adapted for connecting/disconnecting with/from a complementary connector in a front-to-back direction, comprising:

a shell comprising a plurality of contacts, said surfaces defining a receiving space, one of the surfaces forming a pair of resilient tabs bent into the receiving space, an insulative housing received in the receiving space with a plurality of receiving passageways therein;

a plurality of contacts received in the receiving passageways of the insulative housing; and a pair of locking members assembled on the longitudinal opposite ends of the insulative housing and received in the receiving space, each forming a stopping projection projecting therefrom into the receiving space;

a stopping block, and wherein the stopping block comprises a stopping section and an engaging section inserted into the housing;

wherein the resilient labs, respectively, resisting with the stopping projections of the locking members to stop the locking member from moving.

18. The electrical connector as described in claim 17, wherein the housing comprises an upper engaging hole receiving the stopping block for engaging with the contacts in the housing.

* * * * *